US008057222B2

(12) United States Patent
Rangmark et al.

(10) Patent No.: US 8,057,222 B2
(45) Date of Patent: Nov. 15, 2011

(54) DIRECT FLAME IMPINGEMENT BURNER

(75) Inventors: Lennart Rangmark, Älvsjö (SE); Tomas Ekman, Saltsjö- Boo (SE)

(73) Assignee: AGA AB, Lindingö (SE)

( * ) Notice: Subject to any disclaimer, the term of this patent is extended or adjusted under 35 U.S.C. 154(b) by 1263 days.

(21) Appl. No.: 11/418,706

(22) Filed: May 6, 2006

(65) Prior Publication Data

US 2007/0248923 A1 Oct. 25, 2007

(30) Foreign Application Priority Data

Apr. 25, 2006 (SE) ..... 0600901

(51) Int. Cl.
*F23C 7/00* (2006.01)

(52) U.S. Cl. ..... 431/187; 431/350; 239/450; 239/553.5; 239/565

(58) Field of Classification Search ..... 431/350, 431/179, 181, 182, 187; 239/450, 548, 553.5, 239/565, 566
See application file for complete search history.

(56) References Cited

U.S. PATENT DOCUMENTS

| | | | | |
|---|---|---|---|---|
| 4,533,314 | A * | 8/1985 | Herberling | 431/4 |
| 5,725,367 | A * | 3/1998 | Joshi et al. | 431/8 |
| 5,743,723 | A * | 4/1998 | Iatrides et al. | 431/8 |
| 6,074,197 | A * | 6/2000 | Philippe | 431/10 |
| 6,783,357 | B2 * | 8/2004 | Joshi et al. | 431/161 |

* cited by examiner

*Primary Examiner* — Steven B McAllister
*Assistant Examiner* — Sarah Suereth
(74) *Attorney, Agent, or Firm* — Alfred J. Mangels

(57) ABSTRACT

A direct flame impingement burner including a metal block with a fuel inlet and an oxidant inlet and at least two outlet nozzles having a set of identical nozzle outlet openings. The oxidant inlet is connected with an oxidant chamber within the block that is connected with at least one oxidant outlet opening in the set of nozzle outlet openings by passageways of identical length and cross-sectional area. The fuel inlet is connected with a fuel chamber within the block that is connected with at least one fuel outlet opening in the set of nozzle outlet openings by passageways of identical length and cross-sectional area. The fuel gas pressure is equal over all corresponding fuel outlet openings in the set of openings in each nozzle, and the oxidant gas pressure is equal over all corresponding oxidant outlet openings in the set of openings in each nozzle.

10 Claims, 6 Drawing Sheets

DIRECT FLAME IMPINGEMENT BURNER

BACKGROUND OF THE INVENTION

1. Field of the Invention

The present invention relates to a direct flame impingement burner for heating metallic materials such as blanks, slabs, and the like.

2. Description of the Related Art

Direct flame impingement burners are used for heating various metallic materials. Instead of heating a volume of the atmosphere in, for example, a furnace, and thus heating a material indirectly, the flame impinges directly upon the surface of the material, thus heating it directly. That gives rise to better heat transfer efficiency from the burner to the material.

Such burners are commonly used in, for example, industrial furnaces for the continuous or discreet heating processing of metallic materials. They can also be used separately, for example when preheating or melting materials.

A typical direct flame impingement burner includes a nozzle, in turn including at least one fuel opening and one oxidant opening, from which fuel and oxidant are dispatched, respectively.

Such a typical direct flame impingement burner is fed with a gaseous fuel, for example natural gas, and a gaseous oxidant, for example oxygen, for the fuel and the oxidant, respectively. The burner includes fuel and oxidant nozzles that can be arranged at a distance from each other, in order to gain control over parameters such as combustion temperature, $NO_x$ content of combustion products, and the like.

However, in order to optimize the burner behavior arid efficiency in various applications, the respective nozzle openings for fuel and oxidant in the burner head can be arranged in a variety of ways. The choice of arrangement will, among other things, affect the chemical reaction surface between the fuel and oxidant.

Naturally, each nozzle opening needs to be supplied either with fuel or with oxidant. Thus, in an arrangement with several individual openings for both fuel and oxidant, there is a need for multiple supply piping. This is especially true in the common case in which control over the gas pressure in each individual opening is desired for control over the combustion characteristics. In order to fit the supply pipes, valves, and the like, the burner will have to be made quite bulky, something that constitutes a problem in terms of placement in a production line or in an industrial furnace. Also, the cost of production as well as the cost of maintenance of the burner both increase because of the many individual parts.

When heating metallic materials, it is often desired to heat the material uniformly across a larger part of the surface area of the material. For example, when continuously processing metal sheets, it is often desired to obtain a uniform heating profile across the whole width of the processed metal sheet, in order to avoid temperature gradients, and the like. When using direct flame impingement burners, there is therefore a need to use several direct flame impingement burners in conjunction, arranged side by side.

In the case when using several direct flame impingement burners, there is a problem in obtaining a uniform heating profile across all the individual direct flame impingement burners. Namely, in order to obtain such a uniform heating profile, all individual burners need to provide the same heating power to the material. Since the heating power of the direct flame impingement burner depends on the gas pressure of the fuel and the oxidant at each respective opening, those pressures need to be equal in corresponding nozzle openings over the whole range of individual direct flame impingement burners.

When using tubing or piping in order to supply each individual fuel or oxidant nozzle opening, besides the problem of bulkiness, it is difficult to obtain the desired equal gas pressures because of pressure drops that occur in the various parts of the tubing or piping, such as in individual tubes, pipes, valves, connections, and the like. Those pressure drops are often difficult to calculate beforehand, so practical experimentation is necessary in order to make the gas pressures equal between the various nozzle openings, which is costly in terms of time consumption. Also, changes in the piping, replacement of parts, and the like, will possibly affect the final nozzle opening gas pressures, making a recalibration necessary, which is also costly.

The present invention solves the above-described problems.

SUMMARY OF THE INVENTION

The present invention provides a direct flame impingement burner including a metal block and at least two nozzles projecting out from the metal block. Each of the nozzles includes a set of nozzle openings having at least one fuel opening and at least one oxidant opening. The set of openings in each nozzle is identical, including corresponding fuel and oxidant openings. The metal block has only one main fuel inlet and only one main oxidant inlet. The main oxidant inlet is connected to at least one main oxidant chamber, which is connected to at least one oxidant opening in the set of openings in each nozzle via apertures of identical length and cross section. The main fuel inlet is connected to at least one main fuel chamber, which is connected to at least one fuel opening in the set of openings in each nozzle via apertures of identical length and cross section. The gas pressure of fuel or oxidant is equal over all corresponding fuel and oxidant openings in the set of openings in each nozzle.

The expression "corresponding fuel and oxidant openings in every nozzle" refers herein to every corresponding fuel and oxidant opening, respectively, which is arranged in every respective set of openings in every nozzle. Thus, one such corresponding fuel or oxidant opening is present in exactly one instance in every nozzle.

BRIEF DESCRIPTION OF THE DRAWINGS

The structure, operation, and advantages of the present invention will become further apparent upon consideration of the following description, taken in conjunction with the accompanying drawings in which.

DESCRIPTION OF THE PREFERRED EMBODIMENTS

Figure 1:
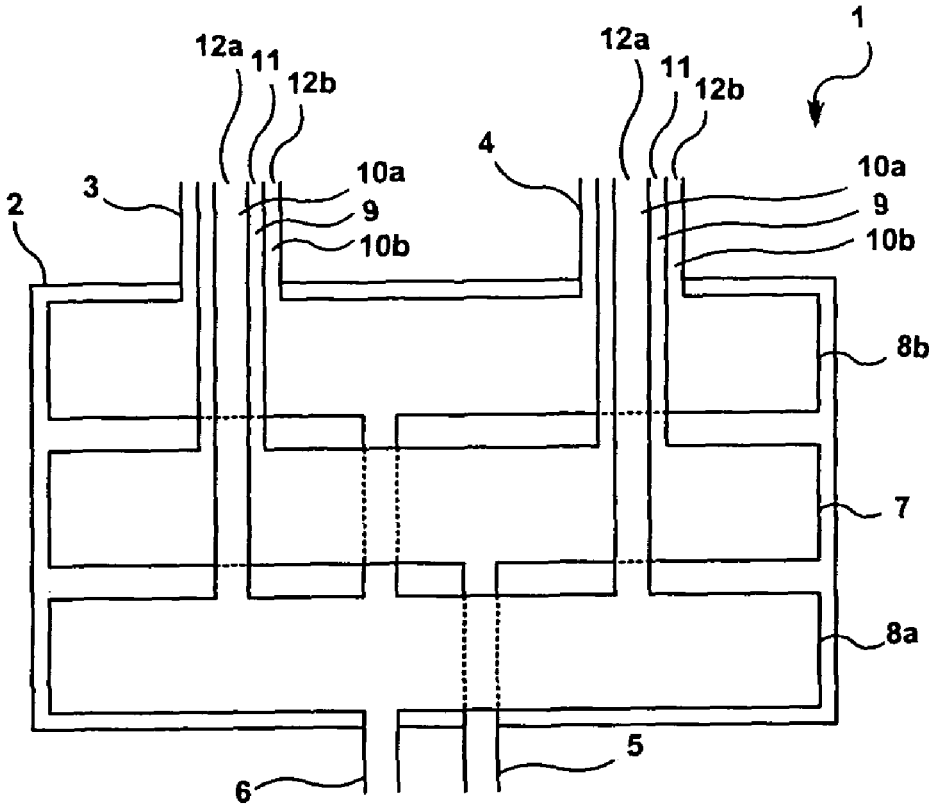
FIG. 1 is a cross-sectional view of a conceptual representation of an embodiment of a burner in accordance with the invention, taken along the line 1-1 of FIG. 2.
Figure 2:
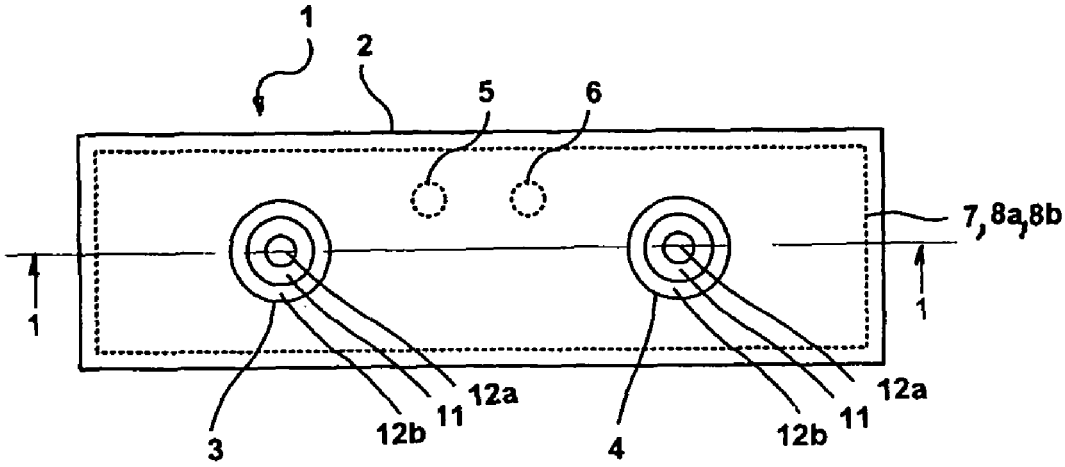
FIG. 2 is a top view of the conceptual representation of an embodiment of a burner in accordance with the invention as shown in FIG. 1.

A preferred embodiment of a burner in accordance with the present invention is shown in detail in FIGS. 3 through 7. However, a conceptual view of a burner in accordance with the invention is shown in FIGS. 1 and 2. All the drawing figures have the same reference numerals for identifying the same parts.

In FIG. 1, a burner 1 is conceptually illustrated, with some parts removed for reasons of clarity. Also, phantom lines indicate non-visible parts. The burner 1 includes a metal block 2, to which one fuel supply conduit 5 and one oxidant supply conduit 6 are connected. The fuel can be any suitable gaseous fuel, such as natural gas. The oxidant can be any suitable gaseous oxidant, preferably an oxidant with more than 85 wt-% oxygen content.

The burner 1 also includes two individual nozzles 3, 4, extending from a surface of the metal block 2. It should be noted, however, that it is not only possible, but in many applications desirable, to provide more than two individual nozzles in a burner in accordance with the present invention, in order to increase the surface area of the metallic material that can be heated uniformly and at the same time.

Every nozzle 3, 4 further includes a fuel opening 11 and oxidant openings 12*a*, 12*b*, through which fuel and oxidant are dispatched, respectively.

The fuel supply conduit 5 extends within the metal block 2 in the form of a channel and connects with a main fuel chamber 7 within the metal block. From the main fuel chamber 7, passageways 9 extend in the form of channels or conduits through the metal block 2, up to each nozzle 3, 4, and terminating at a fuel opening 11 in each of individual nozzles 3, 4.

The dimensions and the geometrical form of the main fuel chamber 7 are such that the gas pressure of the fuel inside the fuel chamber 7 is the same throughout the entire chamber 7. Notably, the fuel gas pressure inside the fuel chamber 7 is the same at the points where each passageway 9 opens into the fuel chamber 7. The cross-sectional area and the length of each passageway 9 are identical for passageways 9 serving different nozzles 3, 4 with fuel. Thus, the fuel gas pressure, and therefore also the flow velocity and volumetric flow of fuel at each fuel opening 11 are the same for each of different individual nozzles 3, 4.

In essentially the same way, the oxidant supply conduit 6 extends within the metal block 2 in the form of a channel. However, unlike the fuel supply conduit 5, the oxidant supply conduit 6 connects with each of two main oxidant chambers 8*a*, 8*b*. From the oxidant chamber 8*a*, passageways 10*a* extend in the form of channels or conduits through the metal block 2 up to each nozzle 3, 4, ending in an oxidant nozzle opening 12*a* in each individual nozzle 3, 4. At the same time, passageways 10*b* run, also in the form of channels through the metal block 2, from the main chamber 8*b* up to each nozzle 3, 4, and terminating at an oxidant opening 12*b*.

As is the case for the main fuel chamber 7 and the fuel-carrying passageways 9, the dimensions and geometrical form of the main oxidant chambers 8*a*, 8*b* are such that the gas pressure is the same at the points where the oxidant-carrying passageways 10*a*, 10*b* open into the respective main oxidant chambers 8*a*, 8*b*, and the length and cross-sectional area of the oxidant-carrying passageways 10*a*, 10*b*, respectively, are identical for each of different nozzles 3, 4, so that the oxidant gas pressure, flow velocity and volumetric flow are the same at the respective nozzle openings 12*a*, and at the respective nozzle openings 12*b*, for each of individual nozzles 3, 4.

Each individual nozzle 3, 4 thus includes a respective set of fuel and oxidant openings. The configuration of the set of openings of each individual nozzle 3, 4 is identical for each of different nozzles 3, 4.

FIG. 2 shows a conceptual view of the burner 1 as viewed from above in FIG. 1, at the nozzle outlet side of the burner.

The fuel- and oxidant-carrying passageways 9, 10*a*, 10*b* are coaxially arranged in an alternating manner, such that the passageways 9, 10*a*, 10*b* are arranged with one passageway inside another. When traversing the coaxially-arranged passageways 9, 10*a*, 10*b* from the inside to the outside, every other passageway is an oxidant-carrying passageway, and every passageway between adjacent oxidant passageways is a fuel-carrying passageway. Thus, the nozzle openings 11, 12*a*, 12*b* are also coaxially arranged in an alternating manner, such that the fuel and oxidant that are discharged from the nozzle openings 11, 12*a*, 12*b* form coaxially arranged fuel and oxidant cylinders or tubes, respectively. That arrangement maximizes the chemical reaction surface between the fuel and the oxidant when they are discharged from each individual nozzle 3, 4, which is preferred.

However, the invention is not limited to using one fuel opening 11 and two oxidant openings 12*a*, 12*b*, that are coaxially arranged in an alternating manner, as shown. The number and the arrangement of the fuel and the oxidant openings can thus be altered in any way suitable for the practical purpose of the embodiment, such as arranging the fuel and oxidant openings in a coaxial and alternating manner but providing more than one fuel opening together with more than one oxidant opening, or arranging the fuel and oxidant openings at a distance from each other in a non-coaxial manner.

The fact that the fuel and the oxidant flow into the metal block 2 through only two conduits 5, 6, respectively, and then through respective chambers and passageways running through the metal block 2, the amount of piping necessary is thus kept to a minimum. In fact, regardless of the number of individual nozzles 3, 4 that are provided, there is always only one fuel supply conduit 5 and one oxidant supply conduit 6. In that way the costs of production and maintenance of the burner 1 are minimized. Furthermore, the design of the burner 1 can be made extremely compact when using a single metal block 2 instead of a number of external pipes or conduits, which increases operational flexibility when positioning the burner 1 in a processing line or inside an industrial furnace.

The provision of main fuel and oxidant chambers 7, 8*a*, 8*b*, respectively, in cooperation with the passageways 9, 10*a*, 10*b*, ensures that the fuel and oxidant gas pressure, flow velocity, and volumetric flow at the corresponding nozzle openings 11, 12*a*, 12*b* are the same when comparing each corresponding nozzle opening 11, 12*a*, 12*b* between different individual nozzles 3, 4. That, in turn, ensures that the heating power of each individual nozzle 3, 4 is the same, despite the fact that only one common fuel supply conduit 5 and only one common oxidant supply conduit 6 is provided, making it possible to obtain a uniform heating profile over several individual nozzles 3, 4 in the same burner 1.

Furthermore, it is possible to alter the dimensions and geometrical forms of the main fuel chamber 7 and the main oxidant chambers 8*a*, 8*b*, as well as the dimensions of the passageways 9, 10*a*, 10*b*. For example, by making the outermost oxidant passageway 10*b* smaller in cross-sectional area than that of the innermost oxidant passageway 10*a*, for each nozzle 3, 4, less oxidant will be output through the outermost oxidant opening 12*b* in each nozzle 3, 4. In that way, the characteristics of the flame that is produced can be altered. However, because the flame characteristics for every nozzle 3, 4 are altered in the same way, the condition of uniformity is preserved even after such an alteration.

The main fuel and oxidant chambers 7, 8*a*, 8*b* in accordance with the present invention are not limited to serving only one corresponding fuel or oxidant nozzle opening 11, 12*a*, 12*b* in the set of openings in each nozzle 3, 4. It is possible to have one main oxidant chamber to provide with oxidant more than one oxidant opening in the set of openings in each nozzle 3, 4, for example.

Figure 3:
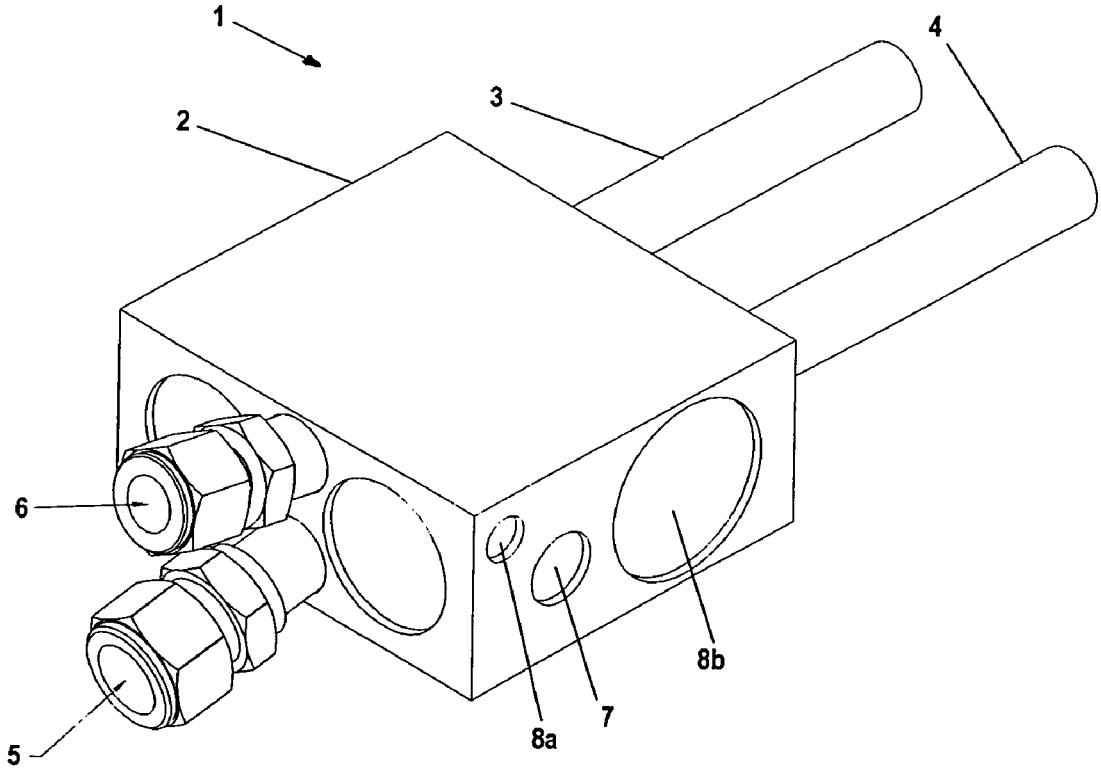
FIG. 3 is a perspective view of an embodiment of an assembled burner in accordance with an embodiment of the invention.
Figure 4:
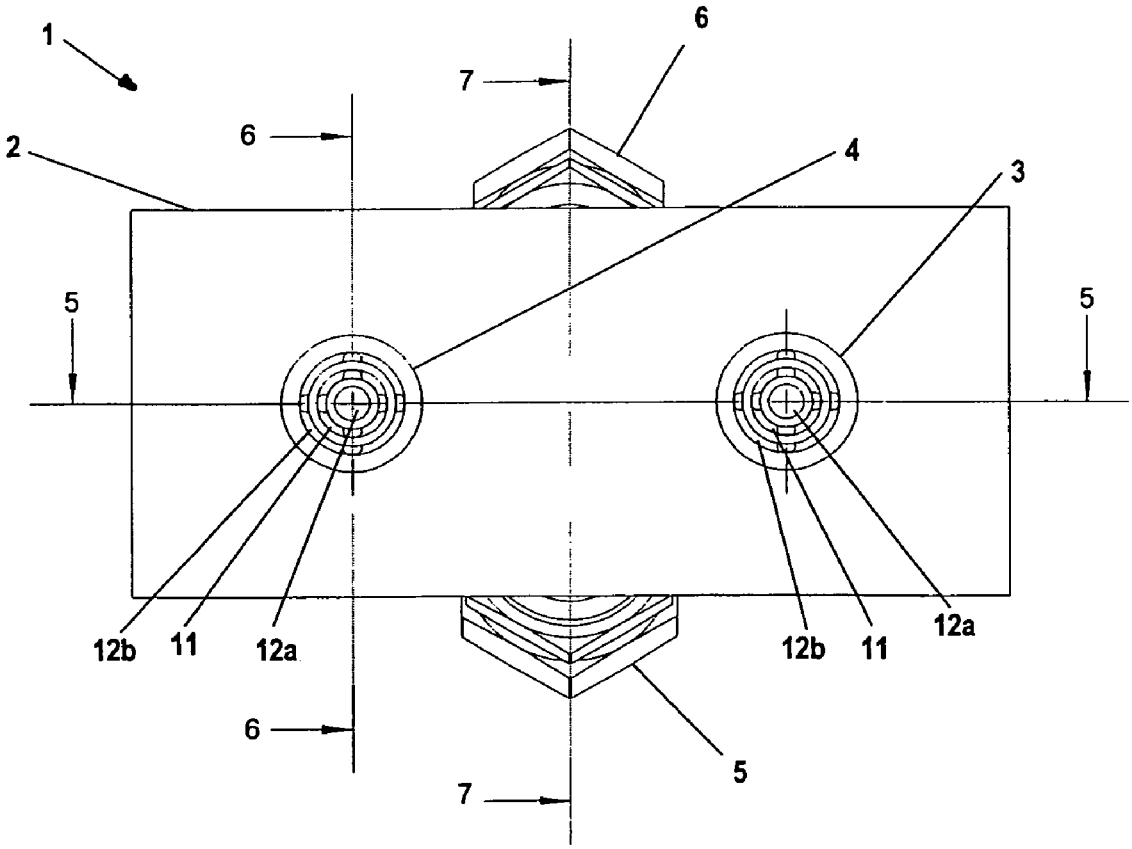
FIG. 4 is a rear view of the burner shown in FIG. 3.
Figure 5:
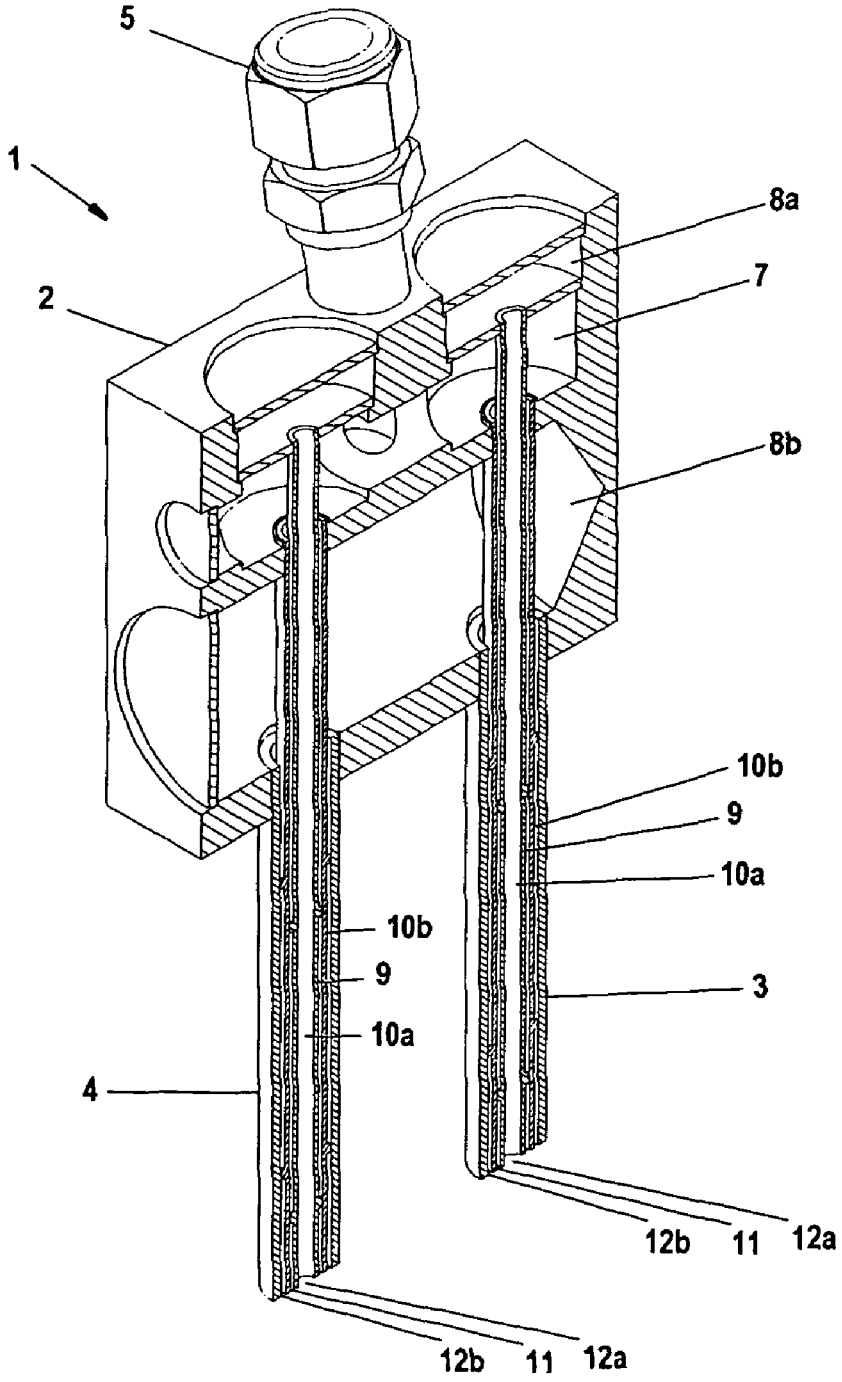
FIG. 5 is a cross-sectional perspective view of the burner shown in FIG. 4, taken along the line 5-5 of FIG. 4.
Figure 6:
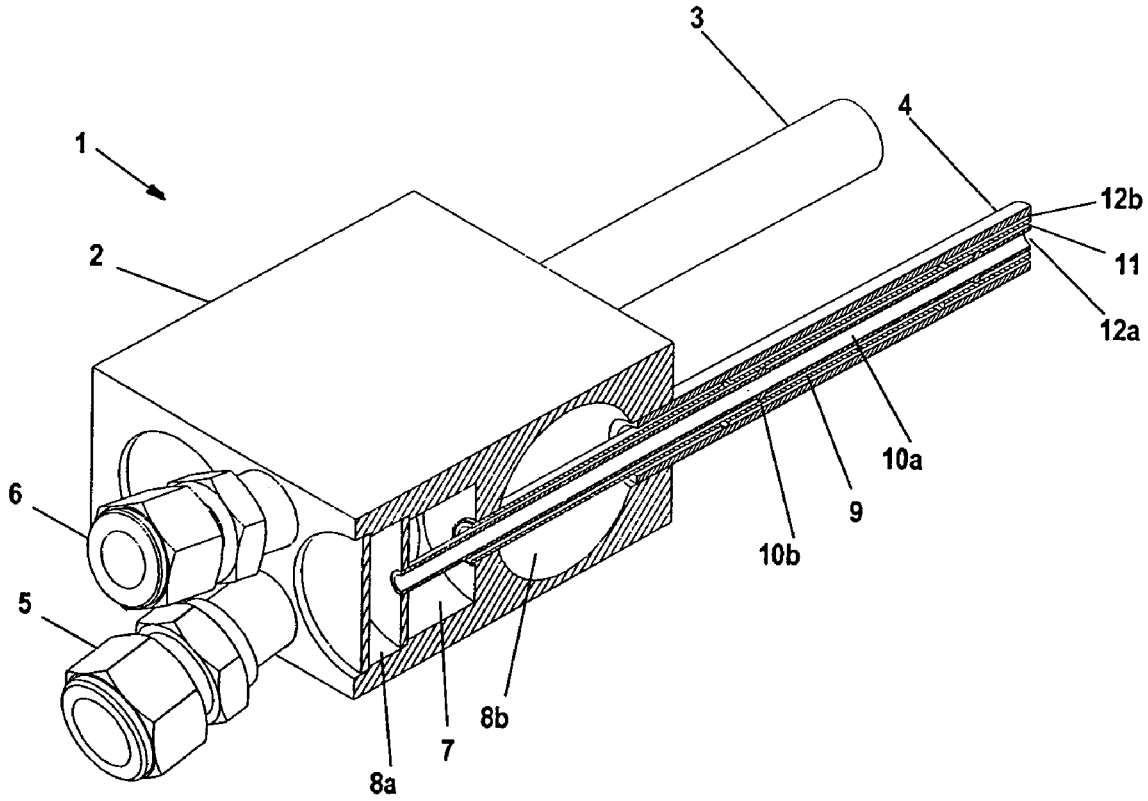
FIG. 6 is a cross-sectional perspective view of the burner shown in FIG. 4, taken along the line 6-6 of FIG. 4.
Figure 7:
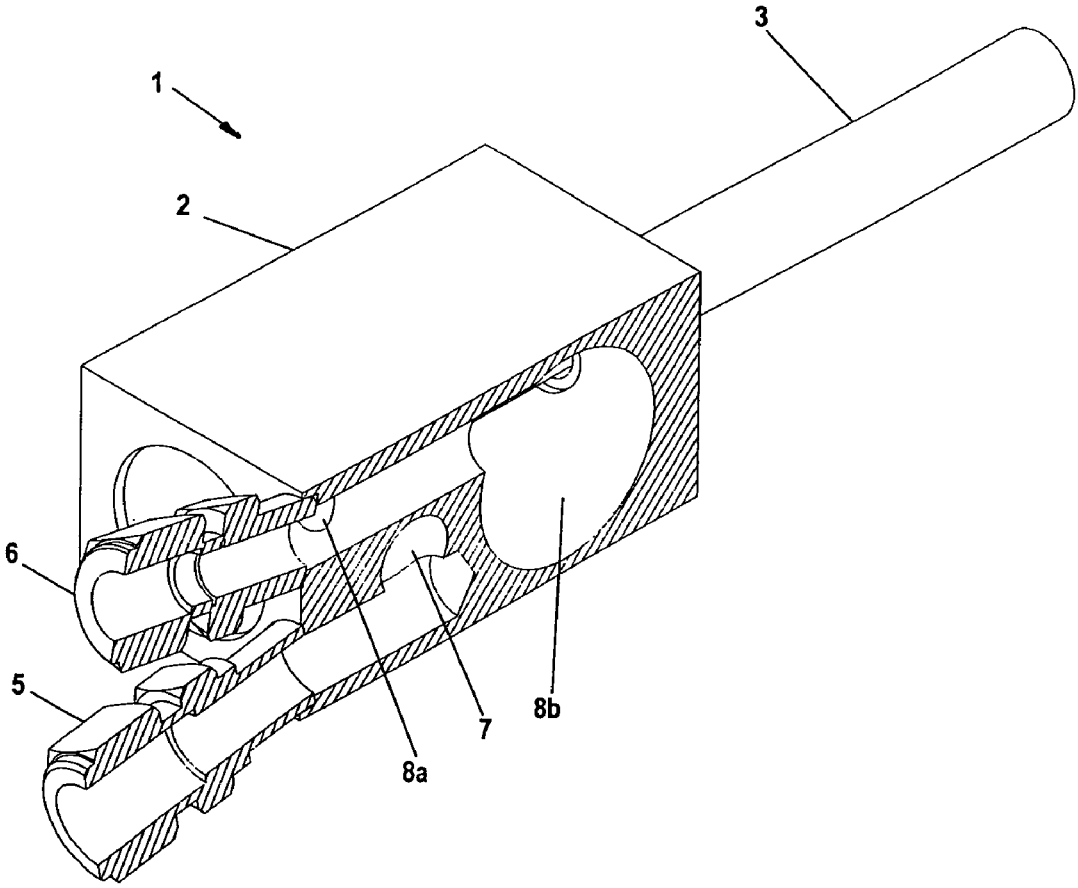
FIG. 7 is a cross-sectional perspective view of the burner shown in FIG. 4, taken along the line 7-7 of FIG. 4.

An inexpensive and convenient way of producing the burner 1 of the present invention is to drill a number of cylindrical holes in the metal block 2, as can be seen in FIGS. 3, 5, and 6, to form the basic geometrical forms of the chambers and passageways inside the metal block 2. Thereafter, metal closures can be arranged to cover the openings of the drilled holes on the sides of the burner, except for the fuel and oxidant conduits 5, 6 and the nozzle openings 11, 12*a*, 12*b*, thus defining the inner chambers and passageways of the burner 1. Care must be taken when drilling and sealing in order for the chambers and passageways to have the correct dimensions in accordance with the invention.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. A direct flame impingement burner comprising: a metal block for introducing fuel and an oxidant into a combustion zone, the block including at least two outlet nozzles extending from the metal block, wherein each of the nozzles has a set of nozzle outlet openings including at least one fuel outlet opening and at least one oxidant outlet opening, and wherein the set of outlet openings in each nozzle is identical and includes corresponding fuel and oxidant outlet openings; a unitary fuel inlet through which all fuel is supplied to the metal block and a unitary oxidant inlet through which all oxidant is supplied to the metal block; wherein the oxidant inlet is connected with at least one oxidant chamber contained within the metal block that is connected with at least one oxidant outlet opening in the set of outlet openings in each nozzle by oxidant passageways of identical length and cross-sectional area; wherein the fuel inlet is connected with at least one fuel chamber within the metal block that is connected with at least one fuel outlet opening in the set of outlet openings in each nozzle by fuel passageways of identical length and cross-sectional area; wherein the oxidant passageways and the fuel passageways are each formed as channels within the metal block; wherein the fuel inlet, the oxidant inlet, the at least one fuel chamber, the at least one oxidant chamber, and the passageways are defined by holes drilled into the metal block, and wherein at least part of the holes are sealed by metal closures on sides of the metal block; wherein respective fuel passageways have identical lengths and cross-sectional areas so that the outlet pressure of fuel is equal at all corresponding fuel outlet openings in the set of outlet openings in each of the outlet nozzles; and wherein respective oxidant passageways have identical lengths and cross-sectional areas so that the outlet pressure of oxidant is equal at all corresponding oxidant outlet openings in the set of outlet openings in each of the outlet nozzles.

2. A burner in accordance with claim 1, wherein the outlet openings of each set of outlet openings in each nozzle are concentrically arranged with alternating fuel and oxidant outlet openings.

3. A burner in accordance with claim 1, wherein each nozzle includes more than two outlet openings.

4. A burner in accordance with claim 1, wherein each fuel chamber is connected with only one correspondingly positioned fuel outlet opening in the set of outlet openings in each nozzle, and wherein each oxidant chamber is connected with only one correspondingly positioned oxidant outlet opening in the set of outlet openings in each nozzle.

5. A burner in accordance with claim 1, wherein oxidant supplied to the burner contains at least 85 wt-% of oxygen.

6. A burner in accordance with claim 1, wherein each fuel chamber defines a fuel-occupying volume that extends laterally outwardly relative to the fuel passageways, and each oxidant chamber defines an oxidant-occupying volume that extends laterally outwardly relative to the oxidant passageways.

7. A burner in accordance with claim 1, wherein the metal block includes two spaced oxidant chambers and a fuel chamber each positioned between the inlet opening and the nozzle outlet openings.

8. A burner in accordance with claim 7, wherein the fuel chamber is positioned between the two oxidant chambers.

9. A burner in accordance with claim 1, wherein the nozzles each include an inner oxidant outlet opening surrounded by an annular fuel outlet opening, and the annular fuel outlet opening is surrounded by an annular outer oxidant outlet opening.

10. A burner in accordance with claim 9, wherein a first oxidant chamber is in fluid connection with the inner oxidant outlet opening and a second oxidant chamber is in fluid communication with the outer oxidant outlet opening.

* * * * *